United States Patent [19]

Verstraeten

[11] Patent Number: 4,685,673

[45] Date of Patent: Aug. 11, 1987

[54] DEVICE FOR CARRYING THE GRAB IN SLOT MACHINE CABINETS

[75] Inventor: Achiel Verstraeten, Sint-Niklaas, Belgium

[73] Assignee: Elektro Automaten Verstraeten PVBA, Sint-Niklaas, Belgium

[21] Appl. No.: 850,310

[22] Filed: Apr. 10, 1986

[30] Foreign Application Priority Data

Oct. 28, 1985 [BE] Belgium ..... PV 2/60827

[51] Int. Cl.[4] ..... A63F 9/00

[52] U.S. Cl. ..... 273/1 GC; 212/205; 273/1 GG

[58] Field of Search ..... 273/1 GC, 1 GG; 221/210; 33/1 M; 212/205, 209, 210, 214, 216, 217, 215, 213

[56] References Cited

U.S. PATENT DOCUMENTS

| | | | |
|---|---|---|---|
| 1,694,084 | 12/1928 | Straight | 212/217 X |
| 2,600,849 | 6/1952 | Collins et al. | 221/210 X |
| 3,572,703 | 3/1971 | Greene | 273/1 GC |
| 3,738,501 | 6/1973 | Gill | 212/217 X |
| 4,597,497 | 7/1986 | Aberegg | 212/205 X |

FOREIGN PATENT DOCUMENTS

| | | | |
|---|---|---|---|
| 1482359 | 4/1967 | France | 221/210 |
| 662305 | 4/1964 | Italy | 222/210 |

*Primary Examiner*—Paul E. Shapiro

*Attorney, Agent, or Firm*—Jordan and Hamburg

[57] ABSTRACT

In a slot machine having a cabinet in which a grab is suspended by means of a cable from a crab which can move in various directions, the grab being capable of picking up prizes from a surface over which the grab is suspended, a traveller travels on first horizontal rails over a horizontal surface for prizes, a crab travels on second horizontal rails perpendicular to first horizontal rails and carried by and on a lower part of the traveller, the traveller includes two vertical side plates on the outwardly facing surface of the upper parts of which are mounted respective rollers for running on the first rails, the second rails are supported at their respective ends by the lower parts of the respective side plates which lower parts are contiguous with the upper parts and include contiguous horizontally outwardly and vertically downwardly bent portions, and the respective ends of the second rails are mounted on the vertically downwardly bent portions whereby the second rails extend over substantially the entire width of the surface for carrying prizes.

4 Claims, 3 Drawing Figures

DEVICE FOR CARRYING THE GRAB IN SLOT MACHINE CABINETS

BACKGROUND OF THE INVENTION AND RELATED ART STATEMENT

The invention is for a device for carrying the grab in slot machines, which device primarily comprises a traveller moving on first guide rails installed in the cabinet of the slot machine, a crab moving on second guide rails installed in the said traveller and a grab for raising the prizes located on a lower prize area of the slot machine. The grab is suspended by means of a cable attached to an elevating mechanism installed in the crab.

In a known device of this sort, the traveller is held between two flat vertical side plates which are located on the inside of the guide rails for the traveller. Guidance means, such as rollers, are fixed on the traveller, and the rollers rest on the guide rails. Vertical panels perpendicular to the guide rails are fitted between the guide rails. A crab, from which the grab is suspended for raising the prizes, moves between the vertical panels.

This device has as a chief disadvantage that the travel of the crab is limited in both directions, as it cannot run under the guide rails of the traveller and thus stays at a relatively great distance from the glass sides of the slot machine. The result of this is that a fairly large strip of the prize area, on the sides of the slot machine, are inaccessible by the grab suspended from the crab. The available prize area of the machine is thus limited.

OBJECTS AND SUMMARY OF THE INVENTION

The object of the present invention is to eliminate the disadvantages of the known device and to provide an improved device for carrying a grab in a slot machine, wherein the entire prize area can be fully utilized.

The traveller of the slot machine is, according to the main characteristic of the invention, held between two vertical side elements or plates installed in the direction of movement of the crab. The upper part of the side element is situated inside the guide rails and carries the guidance means which rests on and moves over the guide rails. The lower part of each side element or plate is recessed outwards with respect to the upper part and extends under the adjoining guide rail, where the rails for the crab from which the grab is suspended are located.

In this way, it is possible to use almost the entire width of the prize area of the slot machine where the prizes are displayed, thereby to allow more prizes to be put in the slot machine than before. Further, because of the sharp bend in the side elements or plate, the traveller is considerably reinforced, while it also remains possible to remove the traveller with the crab and the grab from the cabinet of the slot machine by simply raising the traveller and turning it in the horizontal plane between the guide rails.

DETAILED DESCRIPTION OF A PREFERRED EMBODIMENT

Figure 1:
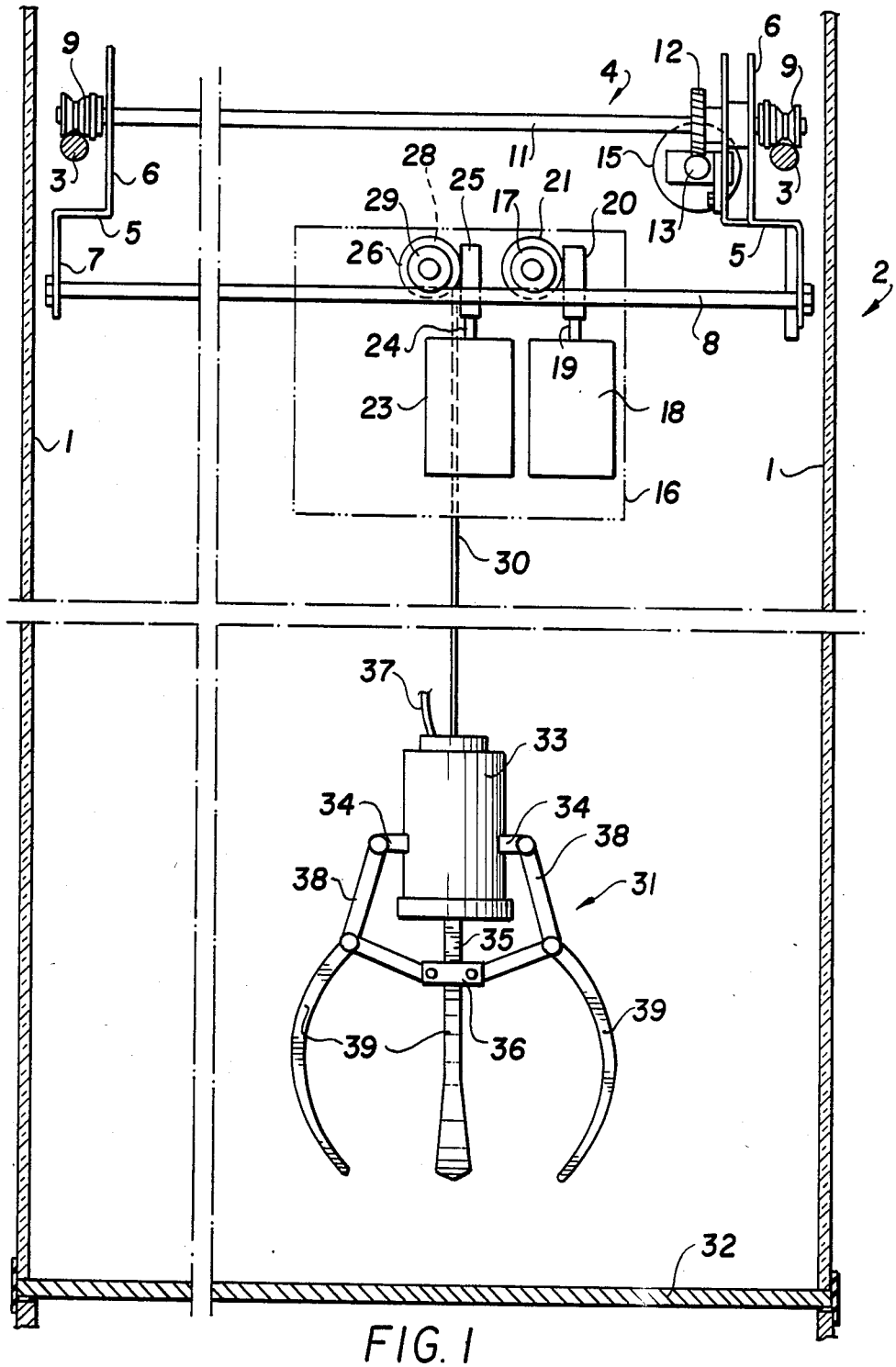
FIG. 1 is a front elevation of the device installed in the cabinet of a slot machine, where the cabinet is shown as a cross section.
Figure 2:
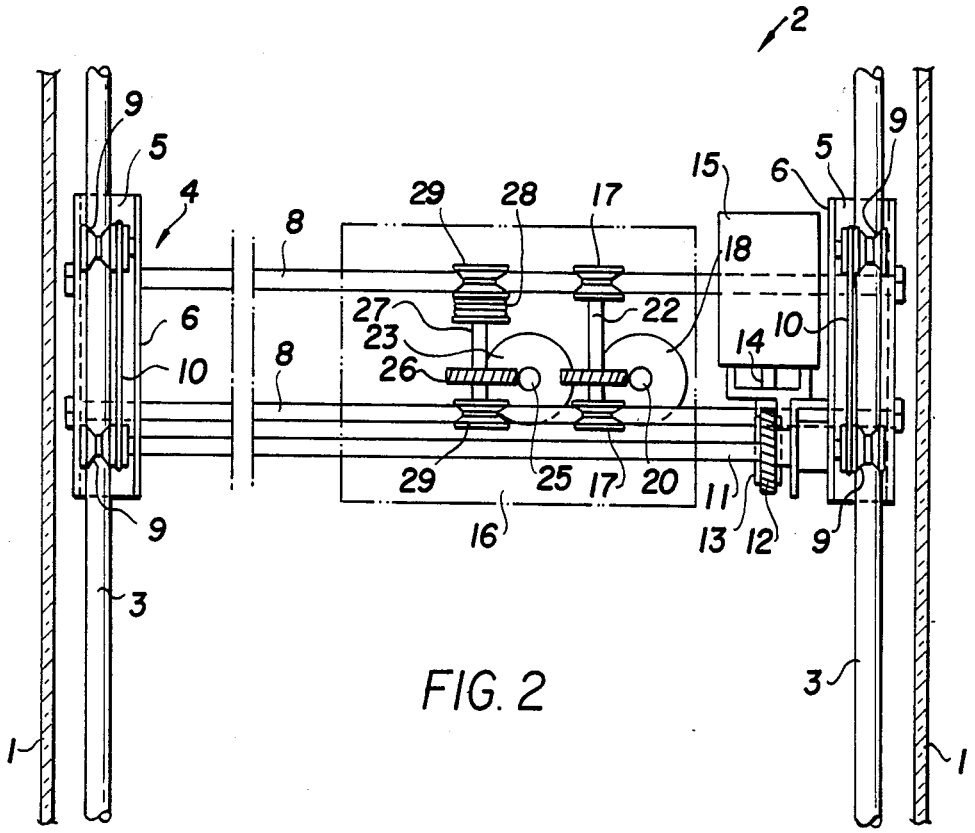
FIG. 2 is a plan view.
Figure 3:
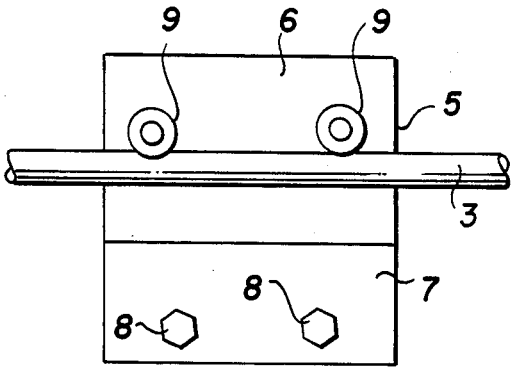
FIG. 3 is a side view of the side plates of said device.

In these figures, it can be seen that close to glass walls 1 of a cabinet 2 of the slot machine, two guide rails 3 are installed parallel to one another. A traveller 4 moves over these guide rails. The traveller 4 includes two vertical side plates 5 which extend parallel to the guide rails 3. Each side plate 5 has an upper part 6 which is mounted adjacent to the inner side of the guide rail 3. The upper part 6 is bent horizontally at the bottom thereof at 90° and again bent vertically at 90° so that a lower part 7 is formed which extends parallel to the upper part 6 of the side plate 5 under the adjoining guide rails 3. Between the lower parts 7 formed on the two side plates 5, two parallel guide rails 8 are installed which extend perpendicular to the guide rails 3. Each of the side plates 5 is provided with two rollers 9 which rest on the guide rail 3. Each pair of rollers 9 fitted on each side plate 5 is connected by a drive belt 10. On a driving shaft 11 for the two foremost rollers 9, a worm or screwgear 12 is fitted, which meshes with a worm 13 forming a part of a driving shaft 14 of an electric motor 15 mounted on one of the side plates 5. In this way, the electric motor 15 drives the rollers 9, and the traveller 4 moves in the known way over the guide rails.

The two guide rails 8, installed between the side plates 5, bear a crab 16 which rests on the guide rails 8 by means of rollers 17. An electric motor 18 is installed in this crab 16 in order to propel the crab 16 on the guide rails 8. The crab can be moved in both directions, even to a position close to the wall 1 as a result of the special embodiment of the side panels 5. A drive shaft 19 of the electric motor 18 is provided with a worm 20 which meshes with a worm or screwgear 21 fixed on a shaft 22 of the two rollers 17, so that the rollers 17 are driven by the motor. A second motor 23 is also installed in the crab 16 and includes a shaft 24 having a worm 25 which meshes with a worm or screwgear 26 fitted on a shaft 27 of a cable drum 28. The shaft 27 also carries two rollers 29. A lifting cable 30 for a grab 31 is attached to the cable drum 28 and serves to raise and lower the grab.

The grab 31 comprises a casing 33 to which the cable 30 is connected, and three projections 34 extending radially outwardly from the casing 33 and spaced apart at the same interval around the casing 33. Situated inside the casing 33 is a solenoid coil (not shown) having a rod 35 with an end portion 36. An electric cord 37 for operating the solenoid coil extends from the casing 33 and is connected to a suitable electric supply. When the solenoid is actuated, the rod 35 is moved upward. On the contrary, when the solenoid is not actuated, the rod 35 is located at the lowest position due to its own weight.

Pivotally attached to each projection 34 is an arm 38. An arm 39 pivotal connected to the end portion 36 at one end is also pivotally connected to the arm 38. Accordingly, when the solenoid coil is actuated to place the end portion 36 at the upper position, the free ends of the arms 38 are located close to a central axis of the casing 33. In this position, a prize can be grabbed by the arms 38. When the solenoid coil is not actuated, the end portion 36 is located at the lower position, so that the free ends of the arms 38 are located away from the central axis of the casing 33.

In the slot machines of the invention, when an operator inserts a coin, the traveller 4 can be moved along the guide rails 3, and the crab 16 can be moved along the guide rails 8. When the two movements of the traveller 4 and the crab 16 have been completed, the grab 31 is moved downwardly, and then the solenoid coil is actuated. Consequently, the arms 39 are closed to grab a prize. No matter if the prize is grabbed, soon after the arms 39 are closed, the grab 31 is raised. Thereafter, the traveller 4 and the crab 16 are automatically moved to a predetermined position, wherein the solenoid coil is operated to open the arms 39. If a prize was grabbed, the prize falls into an opening, so that the operator can obtain the prize.

As a result of the guiding rails 8 extending to the maximum length, the crab 16 as well as the grab 31 can be moved over virtually the entire width of a prize area 32 on which the prizes are displayed. As a result, the useful area of the prize area 32 is considerably increased. Similarly as a result of the special embodiment of the side plates 5, the construction of the traveller is considerably robuster and it is possible, as usual, to remove the traveller with the crab 16 and the grab 31 from the cabinet of the slot machine, by raising it and turning it in the horizontal plane between the guide rails 3 when this may be necessary, such as when carrying out repairs.

Of course the form, dimensions, and the nature of the side plates 5 may be changed and these side plates could be replaced by similar elements which lead to the same result. The present invention is limited only by the appended claims.

What is claimed is:

1. A crane type slot machine adapted to lift a prize in the machine by means of a crane, comprising:

a cabinet having a prize area;

first guide rails spaced apart from each other, said guide rails being situated inside the cabinet above the prize area, a traveller situated above the first guide rails and extending throughout the entire width of the cabinet perpendicular to the first guide rails, said traveller including a first driving shaft extending between the first guide rails, two first rollers each fixed to a respective end of the driving shaft and situated on the respective first guide rails, two side plates each having an upper part situated inside the first roller and a lower part situated adjacent the cabinet under the first guide rails, two parallel second guide rails situated between the lower parts of the side plates perpendicular to the first guide rails, and a first motor fixed to one of the side plates and operationally connected to the driving shaft so that when the first motor is operated, the traveller moves along the first guide rails, a crab situated above the second guide rails, said crab including a second driving shaft extending between the second guide rails, two second rollers each fixed to a respective end of the second driving shaft and situated on the respective second guide rails, a second motor operationally connected to the second driving shaft so that when the second motor is operated, the crab moves along the second guide rails, a cable drum situated on the crab, a cable extending from the cable drum, and a third motor operationally connected to the cable drum so that when the third motor is operated, the cable drum rotates to wind or extend the cable, and a grab connected to an end of the cable, said grab including a plurality of arms and means for actuating the arms, said actuating means, when actuated, operating the arms to move close to each other to thereby allow the arms to grab a prize, said actuating means, when not actuated, permitting the arms to locate away from each other.

2. A crane type slot machine according to claim 1, in which portions of each of the side plates contiguous with each other and with the bottom of the upper part of the respective side plate are bent horizontally outwardly and vertically downwardly, respectively, to form the lower part, whereby the crab situated on the second guide rails formed between the lower parts of the respective side plates can move throughout the entire width of the cabinet.

3. A crane type slot machine according to claim 2, in which said traveller further includes additional two first rollers rotationally connected to the upper parts of the respective side plates and situated on the respective first guide rails, and two drive belts connecting the first rollers to the adjacent additional first rollers respectively, so that the traveller can move smoothly over the first guide rails.

4. A crane type slot machine according to claim 3, in which said crab further includes a shaft parallel to the second driving shaft, two additional second rollers situated on the shaft and placed over the second guide rails respectively to support the crab stably on the second guide rails, said cable drum being situated on the shaft.

* * * * *